US005893279A

United States Patent [19]

Schantz et al.

[11] Patent Number: 5,893,279

[45] Date of Patent: Apr. 13, 1999

[54] LID-SWITCH WITH OUT-OF-BALANCE DETECTION

[75] Inventors: Spencer C. Schantz, Dousman; David G. Hackbarth, New Berlin; David M. Howie, Waukesha, all of Wis.

[73] Assignee: U.S. Controls Corporation, New Berlin, Wis.

[21] Appl. No.: 08/757,523

[22] Filed: Nov. 27, 1996

Related U.S. Application Data

[63] Continuation-in-part of application No. 08/444,596, May 18, 1995, Pat. No. 5,685,038.

[51] Int. Cl.[6] ..... D06F 33/02

[52] U.S. Cl. ..... 68/12.06; 68/12.26; 200/61.7; 200/61.52; 200/61.76

[58] Field of Search ..... 68/12.02, 12.06, 68/12.26, 23.3; 200/61.7, 61.52, 85 R, 61.76

[56] References Cited

U.S. PATENT DOCUMENTS

| | | | |
|---|---|---|---|
| 2,311,545 | 2/1943 | Hurley et al. | 68/23.1 |
| 2,311,924 | 2/1943 | Bassett, Jr. | |
| 2,882,360 | 4/1959 | Sisson | 68/21.26 |
| 3,098,372 | 7/1963 | Bochan | |
| 3,149,212 | 9/1964 | Smith | |
| 3,440,373 | 4/1969 | Blewitt, Jr. | 200/61.7 |
| 3,504,777 | 4/1970 | Waugh | 68/12.26 |
| 3,602,015 | 8/1971 | Hughes | 68/12.26 |
| 3,716,122 | 2/1973 | Baker et al. | 200/61.7 |
| 3,761,653 | 9/1973 | Eranosian | 200/61.52 |
| 3,889,078 | 6/1975 | Wessman | 200/61.7 |
| 4,098,098 | 7/1978 | Altnau | 68/12.26 |
| 4,311,891 | 1/1982 | Faust | |
| 4,455,461 | 6/1984 | Maguire | |

FOREIGN PATENT DOCUMENTS

| | | | |
|---|---|---|---|
| 59-82893 | 5/1984 | Japan | 68/12.26 |

*Primary Examiner*—Frankie L. Stinson
*Attorney, Agent, or Firm*—Quarles & Brady

[57] ABSTRACT

A combination lid switch and out-of-balance switch for a residential washing machine or the like employs a pendulum actuated lever to open contacts under a predetermined acceleration after those contacts have been closed by a switch operator communicating with the lid.

13 Claims, 2 Drawing Sheets

LID-SWITCH WITH OUT-OF-BALANCE DETECTION

CROSS-REFERENCE TO RELATED APPLICATIONS

This application is a continuation-in-part of U.S. application Ser. No. 08/444,596 filed May 18, 1995 and entitled: Out-of-Balance Control for Washing Machine now U.S. Pat. No. 5,685,038.

BACKGROUND OF THE INVENTION

The present invention relates to clothes washing machines and in particular to electrical switches used to stop the operation of such machines when the machine's lid is raised or an out-of-balance condition occurs.

Top loading residential washing machines have an upwardly opening tub into which clothes may be placed for cleaning. During operation, the tub and its internal spin basket are filled with water, via a solenoid valve, and a central agitator within the tub agitates the clothes and water to separate the dirt from the fabric ("agitation cycle"). At the conclusion of the agitation cycle, the water is drained from the tub and the spin basket is spun about its axis to remove water from the wet clothes by centrifugal force ("spin cycle").

During the spin cycle, if the wet clothes are unevenly distributed about the axis of the spin basket, the rapidly rotating spin basket may become unbalanced. Minor unbalance is accommodated by mounting the tub (including the spin basket) to "float" with respect to the housing of the washing machine, i.e., so that some movement between the two can occur. Such a floating mounting system may, for example, suspend the tub from the top of the washing machine on one or more pivoting links.

Even with such floating mounting systems, only a limited range of relative motion between the tub and the housing may be accommodated. For severely out-of-balance loads, the movement of the tub will be great enough that the limits of travel of the mounting system will be exceeded. In these cases, the out-of-balance tub may impart sufficient force to the washing machine to cause it to walk or shake unacceptably or the tub may strike the frame of the washing machine potentially damaging the machine itself. For this reason it is desirable to provide a switch that responds to severe out-of-balance conditions to stop rotation of the spin basket so that the user can redistribute the wet clothes.

This function of stopping the out-of-balance spin cycle has previously been accomplished by a "kickout" switch positioned just outside the outer excursion of the tub during mildly out-of-balance operation. During severe out-of-balance operation, the kickout switch is struck by the swinging of the tub and opens the motor circuit stopping the spin cycle. Such a kickout switch is described in U.S. Pat. No. 3,958,094 assigned to the assignee of the present invention and hereby incorporated by reference.

During the spin cycle of the washing machine, it is also important that the lid remain closed to protect the user from injury from the rapidly rotating spin basket. For this purpose, a lid switch is normally positioned near the lid to detect an opening of the lid during the spin cycle and to stop the spin basket if the lid is raised during the spin cycle.

Desirably, the function of the out-of-balance switch and lid switch might be combined into a single unit to reduce costs. Such a combination may require that the lid switch be placed in a less than optimal location as dictated by the dominant mode out-of-balance motion of the spin basket or that additional structure be added to communicate any eccentricity of the spin basket to the location where the lid switch is placed.

BRIEF SUMMARY OF THE INVENTION

The present invention provides a lid switch with out-of-balance detection that may be flexibly located on the washing machine housing according to the demands of its lid switch function. The design employs a pendulum style accelerometer which need not be in direct contact with the spin basket and which can detect out-of-balance oscillations of the washing machine housing in different vibration modes along different axes.

Specifically, the present invention provides a lid switch with out-of-balance detection for a washing machine, the washing machine having a lid openable with respect to a washing machine housing holding a spin basket. The lid switch includes a switch frame having a surface for mounting to the washing machine housing and a switch operator extending from the switch frame to contact the lid when the switch frame is mounted to the washing machine housing. The switch operator moves between a lid closed position, when the lid is closed, and a lid open position when the lid is open. A weight is movably attached to the switch frame to move from a rest position relative to the switch frame with acceleration of the switch frame. A pair of electrical contacts is positioned within the switch frame communicating with the switch operator and the weight to open when the weight moves from the rest position or when the lid is opened.

Thus, it is one object of the invention to provide a cost-effective switch that may detect both out-of-balance and lid open conditions. The use of an accelerometer out-of-balance detector permits the lid switch to be flexibly located on the washing machine housing without direct contact with the spin basket.

The weight may be attached to the switch frame by a pendulum arm including a lever portion moving one of the contacts away from the other when the weight moves from the rest position. The pendulum arm may terminate in a head member positioned away from the weight wherein the pendulum arm attaches to the switch frame by passing upward through a hole in the switch frame to hang downward from the hole suspended by an abutment of the head member against a surface of the switch frame above the hole. The lever portion may be formed by a pivoting of the head member against the switch frame.

It is thus another object of the invention to provide an out-of-balance detector that may be flexibly located with a lid switch and yet sensitive to an arbitrary out-of-balance vibration mode of the washing machine. By forming the lever portion from the pivoting of the head member, lever action may be obtained regardless of the axis along which the pendulum swings.

The lid switch may include a spring which retains the weight at the rest position for accelerations of the switch frame less than a predetermined amount that would indicate an out-of-balance operation of the spin basket. The spring may be sized so that motion of the washing machine housing that does not indicate a contact between the tub and the housing does not open the switch.

Thus it is another object of the invention to provide an out-of-balance detector that may be readily calibrated by adjustment of a spring to prevent partial contact operation for lesser values of washing machine motion. The acceleration of the washing machine housing, caused by contact between the washing machine housing the tub, is significantly greater than the acceleration caused by other sustainable imbalance in the tub. By calibrating the spring so that the out-of-balance detector is triggered only by actual contact between the tub and the washing machine housing, nuisance tripping of the detector is substantially avoided.

The switch operator may include a spring arm moving one of the electrical contacts toward the other when the switch operator moves between a lid open position and the lid closed position, the spring arm flexing to accommodate additional motion of the switch operator after the electrical contacts close. The lid switch may include a stop attached to the switch frame wherein the spring arm moves one of the electrical contacts against the stop when the switch operator moves between the lid open position and the lid closed position and wherein the stop is positioned to permit the weight to move the other contact away from the one contact when the weight moves from the rest position and the one contact is at the stop.

Thus it is another object of the invention to provide a lid switch with out-of-balance detection that may employ a single set of contacts.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

DETAILED DESCRIPTION OF THE INVENTION

Figure 1:
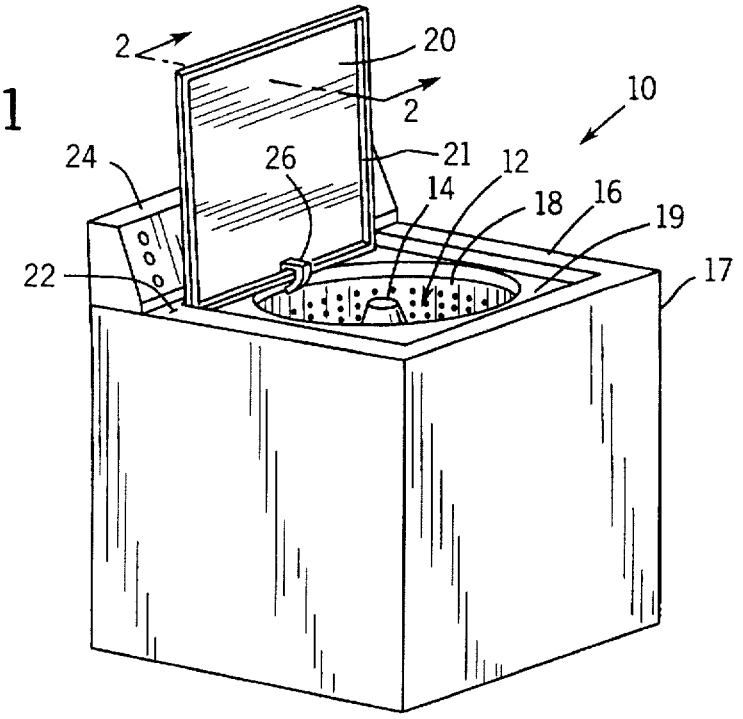
FIG. 1 is a perspective view of a top loading residential washing machine having a rear console and showing a lid in an open position to reveal an arcuate arm used to actuate the lid switch of the present invention.

Referring to FIG. 1, a top loading washing machine 10 provides generally a tub 12 into which clothes may be loaded and washed under the action of a center agitator 14. Access to the tub 12 is provided through a circular opening in a generally planar and horizontal top 16 forming part of a generally stationary washing machine housing 17. The circular opening conforms substantially to the opening of the tub 12 and is ringed by a top flange 18 and extending downward from the circular opening a short distance into the tub 12 to guide clothes into the tub 12.

A square lid 20 may be closed to a horizontal position abutting the top 16 within a shallow recess 19 formed in the top 16. The recess 19 is somewhat larger in area than the lid 20 so that the lid 20 may be closed to lie within the recess 19 flush with the top 16. Water dripping from wet clothes removed from the tub 12 to the top 16 will thus be largely collected by the recess 19. The lid 20 includes a downwardly extending lip 21 providing the lid 20 with additional stiffness and a finished edge.

The lid 20 may open to a substantially vertical orientation by means of a hinge (not shown) permitting rotation of one edge of the lid 20 about a hinge axis 22 along a rear edge of the lid 20. A console 24 supporting the controls of the washing machine 10 is positioned at the rear edge of the top 16 of the washing machine 10 behind the lid 20 when it is open.

Figure 2:
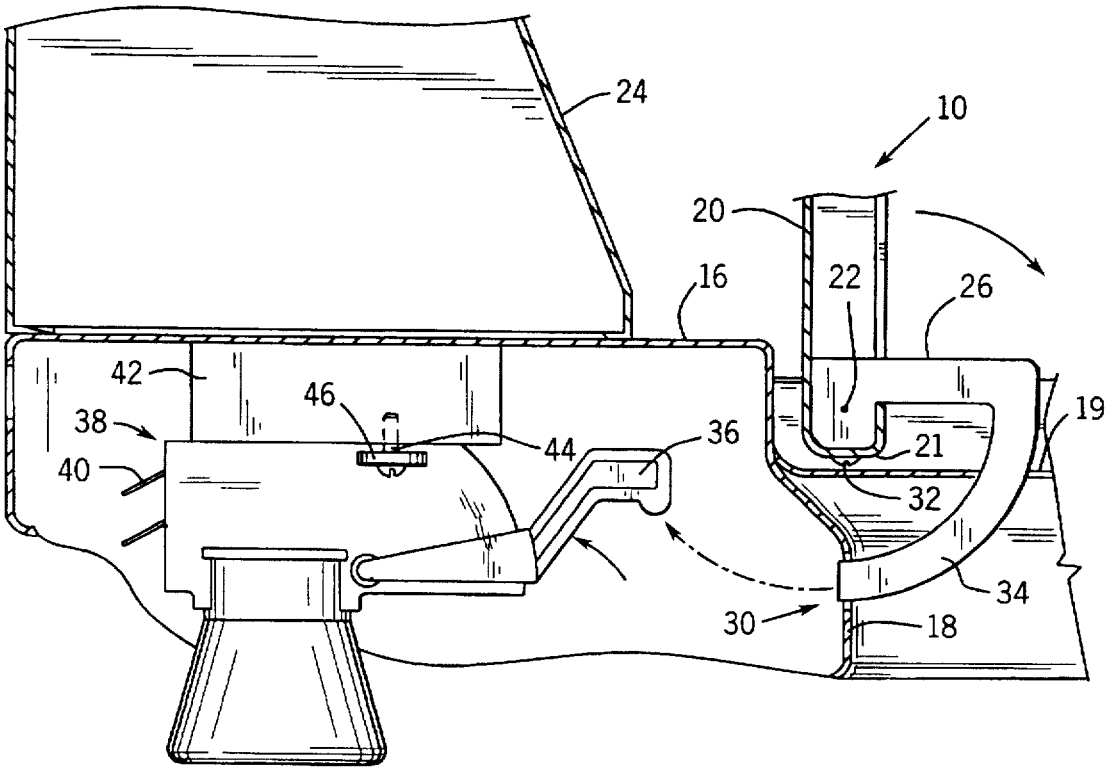
FIG. 2 is a cross-section along lines 2—2 of FIG. 1 showing the arcuate arm positioned to pass through a slot in the top rim to push a switch operator of the lid switch of the present invention.

Referring now to FIGS. 1 and 2, an arcuate arm 26 attaches to the underside of the lid 20 near the hinge axis 22 centered along a rear edge of the lid 20. The arcuate arm 26 extends downward from the lid 20 when the lid 20 is in the closed position and generally Curves rearward about the hinge axis 22 to pass through a slot 30 in the top flange 18 as the lid 20 is opened and closed. The arcuate arm may be constructed from an injection molded plastic to provide a generally rectangular cross-section conforming to the outline of the slot 30 and is secured to the lid by a screw 32 passing through the lip 21 and the lid 20 and into the arcuate arm 26. Screw 32 may be inserted through the lip 21 prior to assembly of the lid 20 to the washing machine 10 to be inaccessible to the user in normal use.

When the lid 20 is in the closed position, a free end 34 of the arcuate arm 26 passes through the slot 30 and moves upward to approach a point proximate to the underside of the top 16 of the washing machine 10 and to push against a first end of a switch operator 36 causing the switch operator 36 to move upward from a horizontal position when the lid 20 is open to an angle of approximately 25° when the lid 20 is closed.

The switch operator 36 is attached to a lid switch 38 of the present invention having a switch frame 40 affixed to the underside of the top 16 of the washing machine by means of a bracket 42 extending downward from that top 16. The bracket 42 is attached to the switch frame 40 by machine screws 44 (only one of which is visible in FIG. 2) passing through side ears 46 of the switch frame 40 of the lid switch 38.

Figure 3:
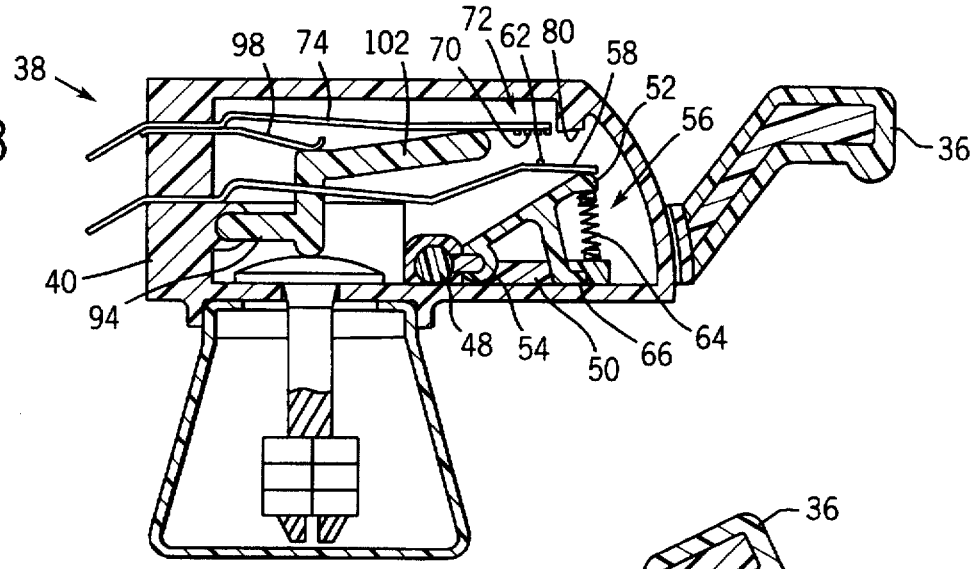
FIG. 3 is an elevational cross-section of the lid switch of FIG. 2 prior to closing of the lid and without an out-of-balance condition.

Referring now to FIG. 3, the switch operator 36 is pivoted about a pivot point 48 attached to the switch frame 40 to provide an internal lever 50 within the switch frame 40 lying in a generally horizontal position when the lid 20 is in the open position. A spring arm 52 is attached at a pivot point 54 to the internal lever 50 of the switch operator 36 near the pivot point 48.

A helical compression spring 64 is captured between a lower surface of the free end 56 of the spring arm 52 and an upper surface of the internal lever 50 of the switch operator 36. When the lid 20 of the washing machine is open, the spring 64 is fully extended and the free end 56 of the spring arm 52 just abuts the lower surface of a leaf spring 60. Upward motion of the spring arm 52 is prevented by a foot 66 extending downward from the spring arm to abut the under surface of the internal lever 50.

Figure 4:
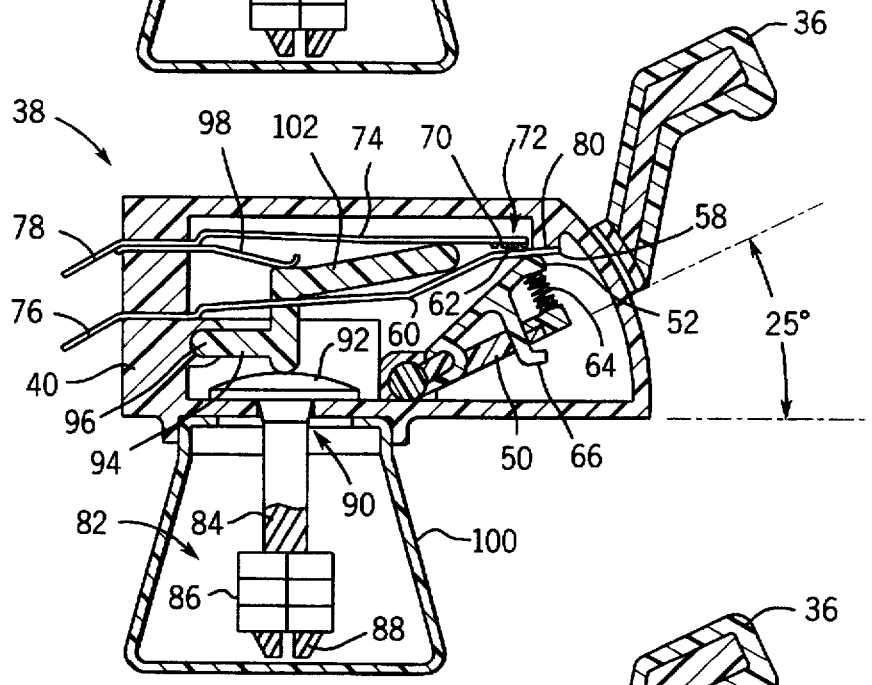
FIG. 4 is a figure similar to that of FIG. 3 showing the lid switch when the lid is in a closed position but without an out-of-balance condition.

Referring now to FIG. 4, when the switch operator 36 is moved upward by approximately 25° under the action of the arcuate arm 26 during closing of the lid 20 of the washing machine 10, the internal lever 50 rises taking with it the spring arm 52. The free end 56 of the spring arm 52 pushed upward on leaf spring 60. Leaf spring 60 supports a first contact 62 on its upper surface. This upward motion of the leaf spring 60 moves the contact 62 into closure with a second contact 70 positioned on the lower surface of a free end 72 of a leaf spring 74.

A stationary end of the leaf spring 60 (removed from the free end 58) is captured by a wall of the switch frame 40 to hold the leaf spring 60 in cantilevered position within the switch frame 40. Leaf spring 60 continues through the switch frame 40 to be exposed outside of the switch 38 as an electrical terminal 76. Likewise leaf spring 74 is held in cantilevered configuration within the switch frame 40, its stationary end removed (opposite the free end 72) being also held in the switch frame 40 and extending therethrough to provide an electrical terminal 78.

When the switch operator 36 is raised by a closing of the lid 20 of the washing machine 10, the contacts 70 and 62 move into abutment to allow a path of electrical flow from electrical terminal 76 through to electrical terminal 78. Current flow between these electrical terminals 76 and 78 permits actuation of the spin basket during the spin cycle according to methods well known in the art.

When the contact 70 and contact 62 close, with a raising of the switch operator 36, the free end 58 of the leaf spring 60 abuts a stop 80 formed in an upper portion of the switch frame 40. The leaf spring 60 may not be moved upward further than this stop 80. Accordingly with greater upward movement of the switch operator 36 or "overtravel", the spring arm 52 flexes downward toward the internal lever 50, compressing spring 64 to make up the difference in motion. Downward flexing of the arm 52 is now possible because the foot 66 has been lifted away from the switch frame 40.

Referring still to FIG. 4, a pendulum 82 is suspended beneath the switch frame 40 to hang vertically downward therefrom. The pendulum 82 includes a pendulum arm 84 supporting at its lower end a weight 86 consisting of several metal washers pressed onto the lower portion of the pendulum arm 84 and held by compressible barb 88. A bell shaped housing 100 may fit about the lower end of the pendulum arm 84 allowing it to swing but protecting it from obstruction and contamination.

An upper end of the pendulum arm 84 passes through an aperture 90 in the bottom of the switch frame 40 and terminates in a disk shaped head 92. The aperture 90 is cut to be somewhat larger than the pendulum arm 84 to permit the pendulum arm 84 to rock within the aperture 90. The disk-shaped head 92 has a flat lower surface resting against the floor of the switch frame 40 when the pendulum 82 is undisturbed. The disk-shaped head 92 is convex on its upper surface to contact at its peak a free end of follower lever 94, the latter which is pivoted to the switch frame at pivot point 96.

A leaf spring 98, one end of which is held with leaf spring 74, extends into the switch frame 40 and at its free end presses down on the follower lever 94. This in turn causes the follower lever 94 to exert a downward force on the disk-shaped head 92 centered on the head 92 and directed along a central axis of the pendulum arm 84. Alternatively, leaf spring 98 could be replaced with a compression helical spring (not shown) held between the upper inner surface of the switch frame 40 and the top of the follower lever 94.

The spring 98 is adjusted so that the force exerted on the disk-shaped head 92 is sufficient to prevent swinging of the pendulum 82 for accelerations of the washing machine 10 less than those that would indicate an unbalanced condition. Thus for incidental vibration of the washing machine 10, the pendulum 82 remains in its vertical position fixed with respect to the switch frame 40.

Figure 5:
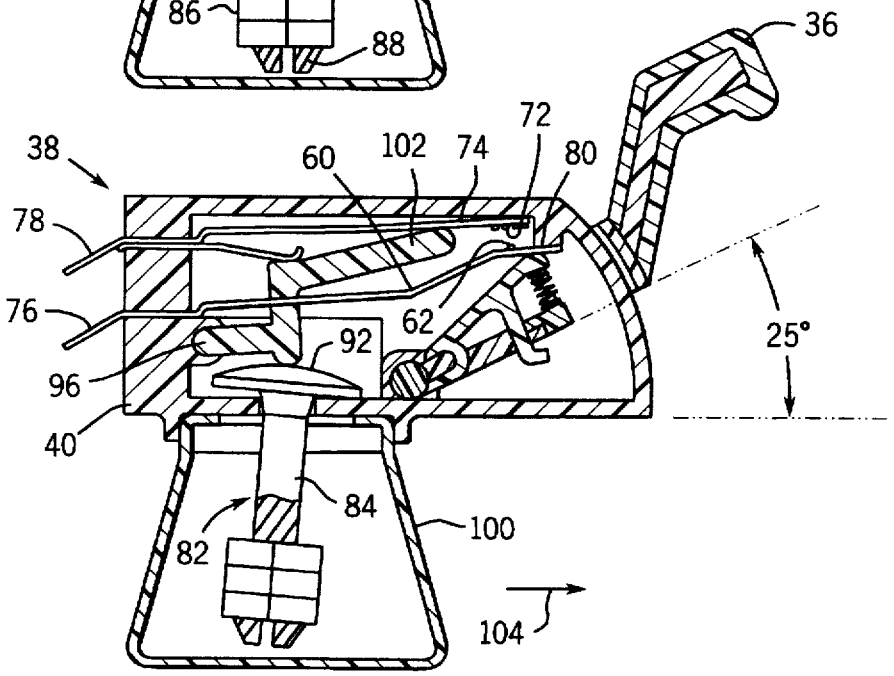
FIG. 5 is a figure similar to those of FIGS. 4 and 3 showing the lid switch when the lid is in a closed position with an out-of-balance condition.

An extension arm 102 connects to the follower lever 94 and extends to a position beneath the leaf spring 74 but not pressing against the leaf spring 74 when the washing machine is not in an out-of-balance condition. Referring to FIG. 5, however, when an out-of-balance condition occurs, an acceleration indicated by arrow 104 may occur. This acceleration causes a force to be exerted on the pendulum 82 causing the pendulum arm 84 to rock away from a vertical axis. This in turn causes the center of the head 92 to rise as a lever, the fulcrum of which is at a point of contact of a periphery of the head 92 with the floor of the switch frame 40. It will be recognized that a symmetrical head 92 can thus provide a lever action raising its center regardless of the angle of rocking of the pendulum arm 84 and regardless of the axis of the acceleration 104.

A rising of the head 92 lifts the follower lever 94 and the extension arm 102. The extension arm 102 moves upward to push upward on a lower surface of leaf spring 74 moving contact 70 away from contact 62 even if the latter is in its full upward position with leaf spring 60 against stop 80. The stop 80 serves thus serves to prevent contact 62 from following contact 70 when the lid 20 is closed and an out of balance condition occurs. The path of electrical flow between terminal 76 and terminal 78 is thus broken when an out-of-balance condition occurs with the lid 20 of the washing machine 10 closed.

This momentary breaking in current flow may be used to stop the operation of the spin basket by unlatching a relay or the like such as is well known in the art. Normally a separate resetting action is necessary to start the washing machine 10 after an out-of-balance condition has been detected.

The amount of acceleration necessary to trigger the out-of-balance operation of the switch may be adjusted by adjusting the weight 86, the geometry of the pendulum 82 and head 92 and the strength of spring 98. As depicted in the figures, the disk-shaped head 92, is symmetrical so the switch 38 is equally sensitive to accelerations in any of 360° within a horizontal plane. Thus the precise modes of oscillation of the washing machine 10 need not be known in advance. Further, the threshold amplitude of acceleration of the switch 38 may be set so as to be insensitive to amplitudes of vibration less than those caused by a first contacting between the tub 12 and washing machine housing 17 resulting from eccentric motion of the tub 12. The amplitude of these "contact" vibrations are sufficiently removed from those produced during non-contacting motion of the tub 12 so as to practically eliminate nuisance tripping of the switch 38 during normal operation of the washing machine 10.

Setting the threshold vibration amplitude to which the switch 38 will be activated may be simply done with a static testing of the force necessary to move the pendulum 82 from its rest position with the head 92 flat against the frame 40. Spring 98 may be adjusted so that the desired force on the pendulum 82 is required.

The resting of the surface of the head 92 of the pendulum 82 against the floor of the switch frame 40 when the pendulum 82 is at rest eliminates motion of the pendulum 82 for vibrational amplitudes of less than the set threshold. This prevents resonant energy storage such as might trip the switch 38 with lesser amplitudes of vibration over longer periods of time.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made:

We claim:

1. A lid switch with out-of-balance detection for a washing machine having a lid openable with respect to a washing machine housing, the washing machine housing holding a spin basket mounted in a tub movable with respect to the housing, the lid switch comprising:

a switch frame having a surface for mounting to the washing machine housing;

a switch operator extending from the switch frame to contact the lid when the switch frame is mounted to the washing machine housing, the switch operator moving between a lid closed position when the lid is closed and a lid open position when the lid is open;

a weight movably attached to the switch frame to move from a rest position relative to the switch frame with acceleration of the switch frame; and a pair of electrical contacts positioned within the switch frame and communicating with the switch operator and the weight to actuate the contacts when the weight moves from the rest position and to actuate the contacts when the lid is opened, and otherwise to deactuate the contacts.

2. The lid switch as recited in claim 1 including a spring retaining the weight at the rest position for acceleration of the switch frame less than a predetermined amount that would indicate out-of-balance operation of the spin basket.

3. The lid switch as recited in claim 1 wherein the weight is attached to the switch frame by a pendulum arm and wherein the arm includes a lever portion moving one of the electrical contacts away from the other when the weight moves from the rest position.

4. The lid switch as recited in claim 3 including in addition a spring biasing the weight to the rest position.

5. The lid switch as recited in claim 3 wherein the pendulum arm terminates in a head member positioned away from the weight, and wherein the pendulum arm attaches to the switch frame by passing upward through a hole in the switch frame to hang downward from the hole suspended by an abutment of the head member against a surface of the switch frame above the hole wherein the lever portion formed by the pivoting of the head member against the switch frame.

6. The lid switch as recited in claim 3 including a spring pressing downward against the head member to exert a force aligned with an axis of the pendulum arm when the weight is in the rest position.

7. The lid switch as recited in claim 1 wherein the switch operator includes a spring arm moving a first one of the electrical contacts toward a stop when the switch operator moves between the lid open position and the lid closed position, the stop being positioned near a second one of the electrical contacts when the weight is in the rest position, the spring arm flexing to accommodate motion of the switch operator after the first one of the electrical contact reaches the stop without further movement of the first one of the electrical contacts toward the second one of the electrical contacts.

8. The lid switch as recited in claim 7 wherein the stop is further positioned to permit the weight to move the second one of the contacts away from the first one of the contacts when the weight moves from the rest position and the first one of the contacts is at the stop.

9. The lid switch as recited in claim 1 wherein the predetermined amount of acceleration indicates a contacting between the tub and the housing caused by motion of the tub.

10. A washing machine comprising:

a housing;

a lid openable with respect to the housing;

a spin basket positioned within the housing to be accessible when the lid is opened;

a tub positioned within the housing to hold the spin basket for rotation therein, the tub mounted for movement with respect to the housing in response to unbalance of the spin basket;

a lid switch attached to the housing and including:

a switch frame having a surface for mounting to the washing machine housing;

a switch operator extending from the switch frame to contact the lid when the switch frame is mounted to the washing machine housing, the switch operator moving between a lid closed position when the lid is closed and a lid open position when the lid is open;

a weight movably attached to the switch frame to move from a rest position relative to the switch frame with acceleration of the switch frame indicating a striking of the tub against the housing; and a pair of electrical contacts positioned within the switch frame and communicating with the switch operator and the weight to actuate the contacts when the weight moves from the rest position and to actuate the contacts when the lid is opened, and otherwise to deactuate the contacts.

11. The washing machine of claim 10 wherein the weight is mounted to the switch frame to move from the rest position in response to accelerations directed at different angles within a horizontal plane.

12. The washing machine of claim 11 wherein the weight is mounted to the switch frame to move from the rest position in response to accelerations directed at any angle within a horizontal plane.

13. An apparatus for detecting out-of-balance operation of a washing machine, the washing machine having a housing holding a spin basket mounted in a tub, the tub being movable with respect to the housing, the apparatus comprising:

a switch frame having a surface for mounting to the washing machine housing;

a weight movably attached to the switch frame to move from a rest position relative to the switch frame with acceleration of the switch frame; and a pair of electrical contacts attached to the switch frame and communicating with the weight to be actuated when the weight moves from the rest position;

wherein the weight and contacts are adjusted so that only a collision between the tub and housing causes actuation of the contacts;

the device further including a spring retaining the weight at the rest position for acceleration of the switch frame less than a pre-determined amount that would indicate out-of-balance operation of the spin basket;

wherein the weight is attached to the switch frame by a pendulum arm and wherein the arm includes a lever portion moving one of the electrical contacts away from the other when the weight moves from the rest position;

the device further including in addition a spring biasing the weight to the rest position;

wherein the pendulum arm terminates in a head member positioned away from the weight and wherein the pendulum arm attaches to the switch frame by passing upward through a hole in the switch frame to hang downward from the hole suspended by an abutment of the head member against a surface of the switch frame above the hole wherein the lever portion formed by the pivoting of the head member against the switch frame.

* * * * *